United States Patent [19]

Tanaka et al.

[11] Patent Number: 4,599,300

[45] Date of Patent: Jul. 8, 1986

[54] DIRECT POSITIVE SILVER HALIDE PHOTOGRAPHIC EMULSIONS

[75] Inventors: Akira Tanaka; Hidetoshi Miura; Masao Koga, all of Nagaokakyo, Japan

[73] Assignee: Mitsubishi Paper Mills, Ltd., Tokyo, Japan

[21] Appl. No.: 675,744

[22] Filed: Nov. 28, 1984

[30] Foreign Application Priority Data

Dec. 6, 1983 [JP] Japan ..... 58-230382

[51] Int. Cl.[4] ..... G03C 5/24; G03C 1/02

[52] U.S. Cl. ..... 430/411; 430/581; 430/596

[58] Field of Search ..... 430/597, 581, 596, 940, 430/411, 412, 589, 582

[56] References Cited

U.S. PATENT DOCUMENTS

| | | | |
|---|---|---|---|
| 3,687,675 | 8/1972 | Gaugh | 430/597 |
| 3,764,338 | 10/1973 | Depoorter et al. | 430/597 |
| 3,846,137 | 11/1974 | Riester et al. | 430/581 |
| 3,941,602 | 3/1976 | Depoorter et al. | 430/596 |
| 3,945,832 | 3/1976 | Shiba et al. | 430/581 |
| 4,175,965 | 11/1979 | Yoshida et al. | 430/598 |
| 4,259,439 | 3/1981 | Tanaka et al. | 430/597 |
| 4,510,235 | 4/1985 | Ukai et al. | 430/598 |

*Primary Examiner*—Won H. Louie

*Attorney, Agent, or Firm*—Cushman, Darby & Cushman

[57] ABSTRACT

There is provided a high speed and high contrast direct positive silver halide photographic emulsion which is free of discoloration by containing therein a dimethine dye having an indolenine ring which contains a cyano group as a substituent.

8 Claims, No Drawings

DIRECT POSITIVE SILVER HALIDE PHOTOGRAPHIC EMULSIONS

FIELD OF THE INVENTION

This invention relates to direct positive, photographic silver halide elements with improved spectral sensitivity. More particularly, it relates to direct positive silver halide photographic emulsions containing a novel spectral sensitizing dye which contains a cyano-substituted indolenine ring in molecular structure.

BACKGROUND ART

Direct positive images can be produced by use of a certain type of silver halide photographic emulsions. An example is a silver halide photographic emulsion comprising fogged gelatino-halide grains, an electron acceptor, a reducing agent, and a compound of metals more electropositive than silver, as described in U.S. Pat. No. 3,501,307. Such a type of emulsion utilizes a spectral sensitization technique in order to increase the sensitivity. Numerous dyes are known as the spectral sensitizers of negative emulsions. When these sensitizers are used in direct positive silver halide emulsion, such dyes exhibits various defects such as flattening of the characteristic curve and often re-reversal. On the other hand, various spectral sensitizers have been proposed for the direct positive silver halide photographic emulsion but those which have satisfactory sensitizing efficiency are limited in number. Although dyes described, for example, in U.S. Pat. Nos. 3,314,796, 3,431,111 and 3,505,070 exhibit an excellent sensitizing efficiency, but they have a regrettable disadvantage of discoloration (color stain) due to the residual dye remained after photographic processings.

The present inventors carried out an extensive study to search a good sensitizing dye which can be used for direct positive emulsions, and have a high sensitizing efficiency without the above defects.

SUMMARY OF THE INVENTION

An object of this invention is to provide a high speed direct positive silver halide photographic emulsion by the use of a novel dimethine dye.

Another object of this invention is to provide a high contrast direct positive silver halide photographic emulsion by use of the novel dimethine dyes.

A still another object of this invention is to provide direct positive silver halide photographic emulsions which are free of the discoloration (color stain) due to the residual dye in the emulsion.

The novel dyes used in the practice of this invention is a dimethine dye having an indolenine ring which contains a cyano group as a substituent.

An especially useful dimethine dye is that which is represented by the following general formula:

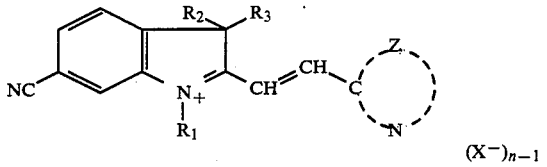

wherein $R_1$ represents a lower alkyl group (e.g. methyl, ethyl, propyl, butyl or pentyl), a hydroxyalkyl group (e.g. β-hydroxyethyl or γ-hydroxypropyl), an acyloxyalkyl group (e.g. β-acetoxyethyl, γ-acetoxypropyl, or β-benzoyloxyethyl), an alkoxyalkyl group (e.g. β-methoxyethyl, β-ethoxyethyl, or β-isopropoxyethyl), a carboxyalkyl group (e.g. carboxymethyl, β-carboxyethyl, or γ-carboxypropyl), an alkoxycarbonylalkyl group (e.g. methoxycarbonylmethyl, ethoxycarbonylmethyl, or β-ethoxycarbonylethyl), a sulfoalkyl group (e.g., β-sulfoethyl, γ-sulfopropyl, or δ-sulfobutyl), an aralkyl group (e.g. benzyl or phenethyl), a sulfoaralkyl group (e.g. sulfobenzyl or sulfophenethyl), or an alkenyl group (e.g. allyl); $R_2$ and $R_3$ represent each a lower alkyl group; Z represents a group of atoms necessary to complete a nitrogen-containing 5- or 6-membered heteroring such as, for ex, pyrrole, indole, carbazole, pyrazole, pyrazolo[1,5-a]pyridine, pyrazolo[1,5-b]pyrazidine, pyrazolo[1,5-a]pyrazine, imidazo[1,2-a]pyridine, 5,6-dihydropyrrolo[2,1-a]isoquinoline, indolizine, or pyrrolo[2,1-a]isoquinoline ring; $X^-$ represents an acid anion (e.g. methyl sulfate ion, ethyl sulfate ion, thiocyanate ion, toluenesulfonate ion, chloride ion, bromide ion, iodide ion, or perchlorate ion); and n is 1 or 2.

Examples of typical dyes used according to this invention are as follows:

| Dye No. | |
|---|---|
| 1 | 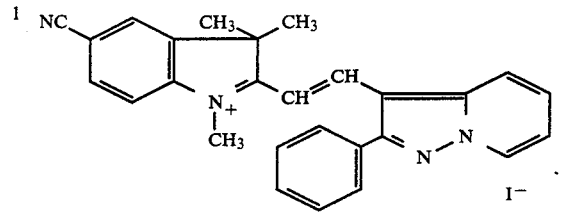 |
| 2 | 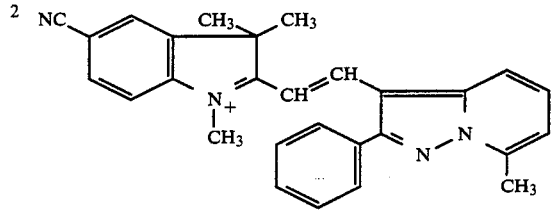 |
| 3 | 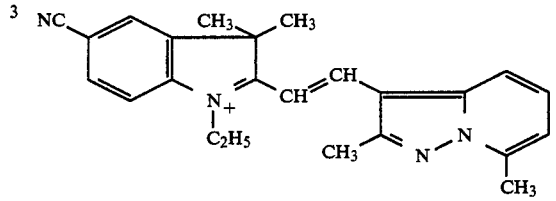 |

-continued
Dye No.
4
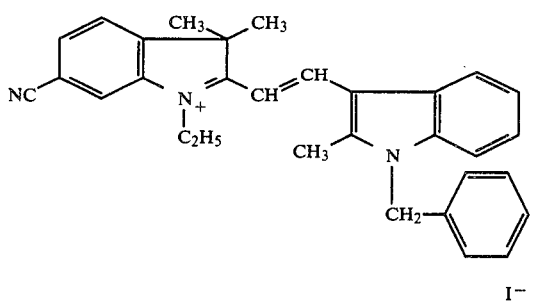
5
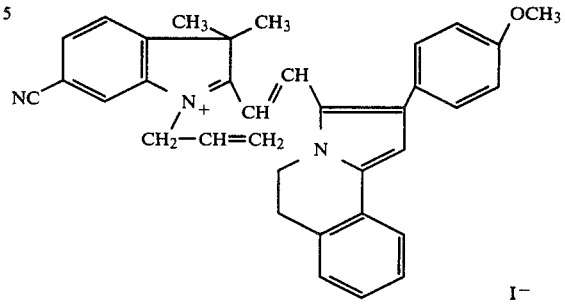
6
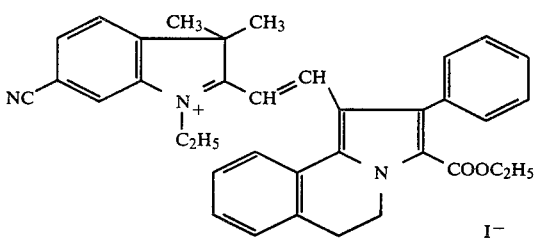
7
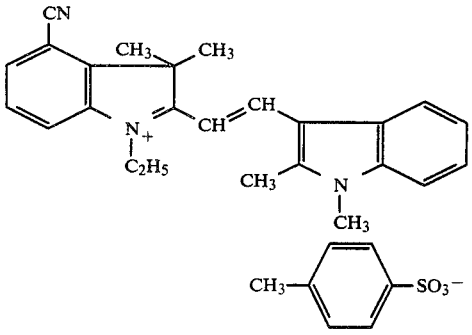
8
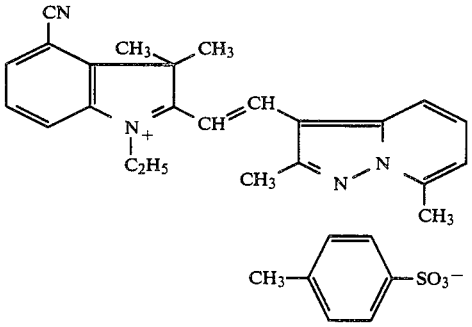
-continued
Dye No.
9
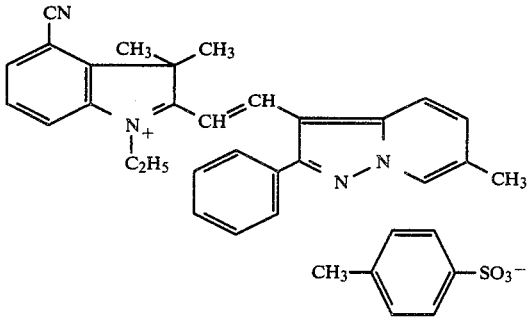
10
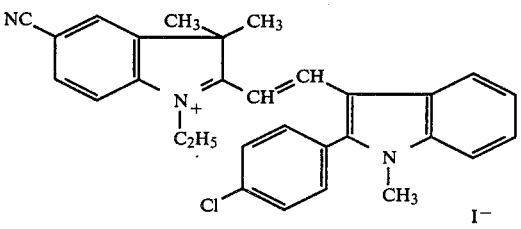
11
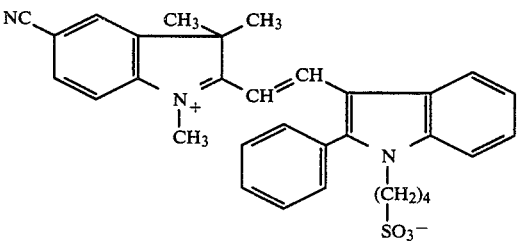
12
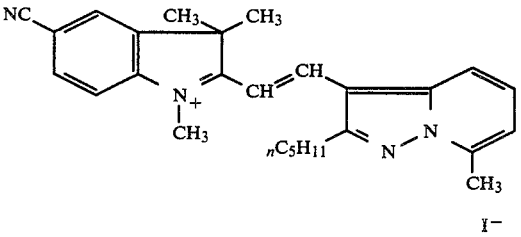
13
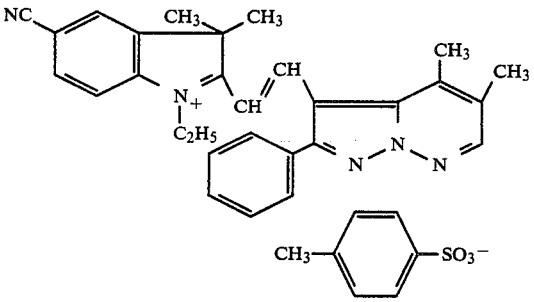
14
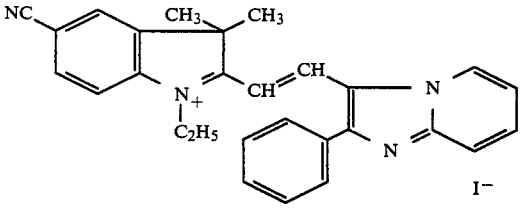

-continued
Dye No.
15
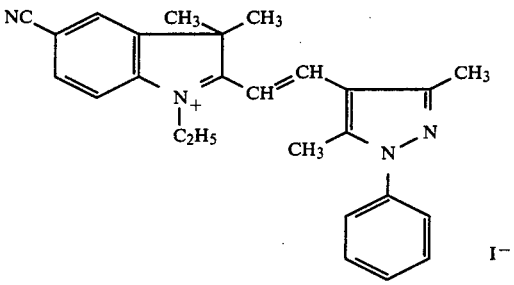
16
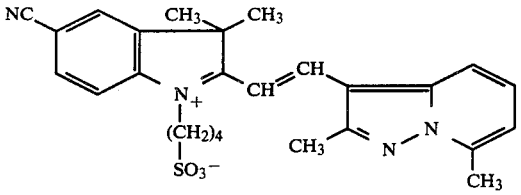
17
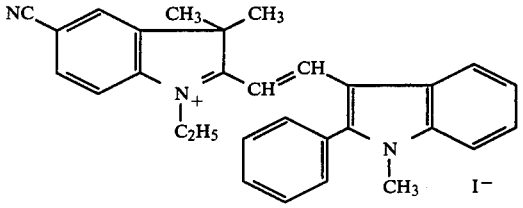
18
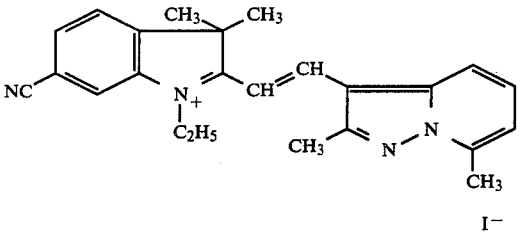
19
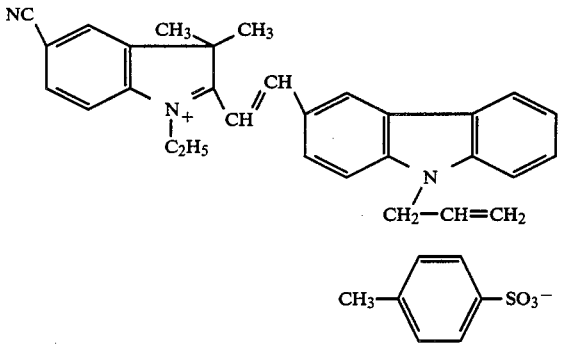
20
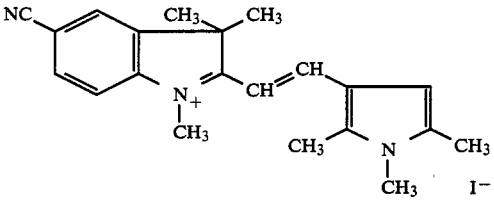
-continued
Dye No.
21
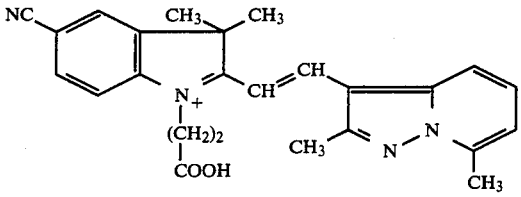
22
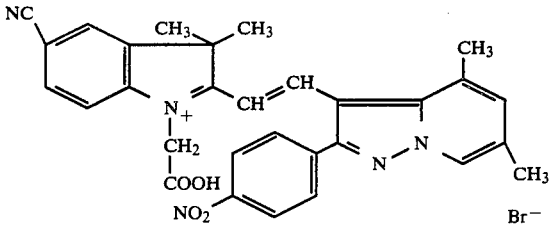
23
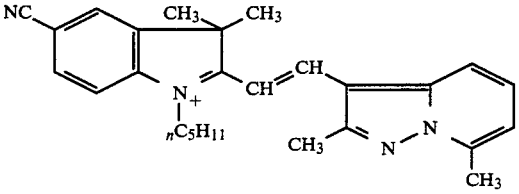
24
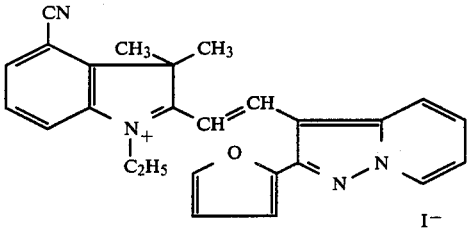
25
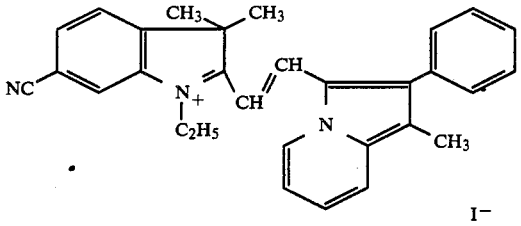
26
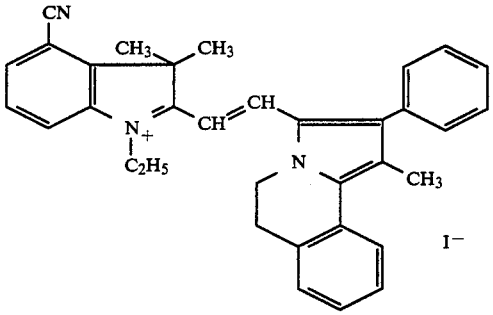

-continued

Dye No.

27

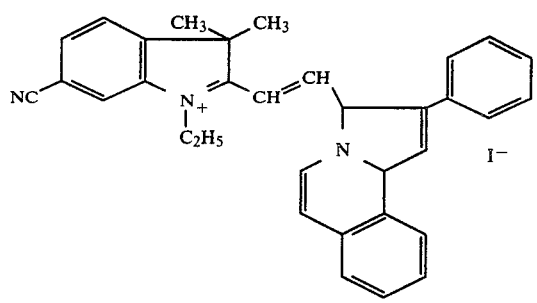

28

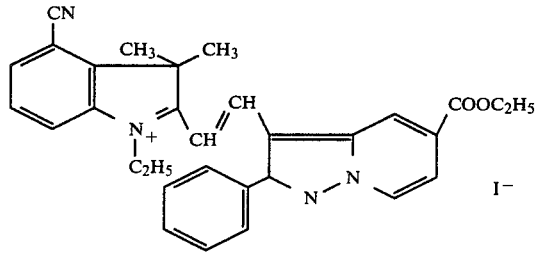

29

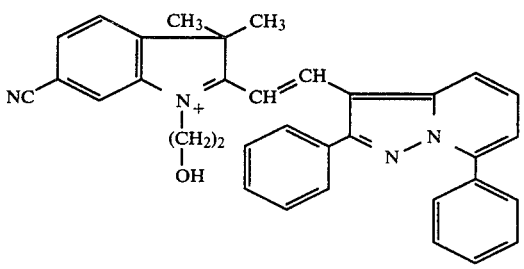

The procedure of synthesizing the novel dimethine dyes used in the emulsion according to this invention is described below with reference to a typical example.

SYNTHESIS OF DYE No. 10

A mixture of 1.35 g of 2-(p-chlorophenyl)-3-formyl-1-methylindole, 1.70 g of 5-cyano-1-ethyl-2,3,3-trimethylinidoleninium iodide, 10 ml of acetic anhydride was refluxed for 15 minutes. The reaction mixture was chilled and the crude dye was collected on a filter and washed with ethyl acetate. After recrystallization from methanol, 1.15 g of pure dye was obtained as brownish-purple crystals, MP 285.5° dec. Other dimethine dyes exemplified above can be easily synthesized in a similar procedures.

The absorption maximum wavelength (nm), in methanol, of each dye is as given below.

| Dye No. | | Dye No. | |
|---|---|---|---|
| 1 | 515 | 2 | 523 |
| 3 | 519 | 4 | 500 |
| 5 | 553 | 6 | 484 |
| 7 | 500 | 8 | 511 |
| 9 | 511 | 10 | 512 |
| 11 | 511 | 12 | 520 |
| 13 | 500 | 14 | 519 |
| 15 | 440 | 16 | 520 |
| 17 | 512 | 18 | 510 |
| 19 | 530 | 20 | 492 |

-continued

| Dye No. | | Dye No. | |
|---|---|---|---|
| 21 | 525 | 22 | 526 |
| 23 | 520 | 24 | 513 |
| 25 | 575 | 26 | 560 |
| 27 | 567 | 28 | 513 |
| 29 | 517 | | |

The addition of dimethine dyes of the general formula (I) into silver halide photographic emulsions is carried out in known ways. For instance, they are added in the form of solution such as methanol, ethanol, isopropanol, pyridine, dimethylformamide, acetone, and water, used each alone or as mixtures. It is also possible to disperse in the emulsion by the ultrasonic means. It is further possible to employ known procedures used in negative emulsions, for example, those described in U.S. Pat. Nos. 3,482,981, 3,585,195, 3,469,987, 3,649,286, 3,485,634, 3,342,605, and 2,912,343. The amount to be added of the dimethine dye varies with various factors of silver halide photographic emulsions, but is preferably in the range of from $1\times10^{-5}$ to $2\times10^{-2}$ mole/mole silver. The addition of the dye into the emulsion can be carried out in any stage of the emulsion production, but the addition just before the coating operation is especially preferred.

The silver halide photographic emulsions used in this invention include emulsions of silver chloride, silver bromide, silver chlorobromide, silver iodide, silver chloroiodobromide, and silver iodobromide. In order to obtain a high speed direct positive silver halide photographic emulsion, it is preferable that 80 mole-% or more of the silver halide be silver bromide. Although the emulsion can be monodisperse or not monodisperse, the former is preferred. The crystal habit of silver halide grains can be either cubic or octahedral, though the former is preferred. The grains are preferably regular in size.

The silver halide grains of the emulsion used in this invention can be such that the grains contain within the grain a nucleus capable of trapping a free electron and are fogged on the surface with a chemical fogging agent. The preparation of such an emulsion is described, for example, in U.S. Pat. Nos. 3,367,778, 3,632,340, and 3,709,689.

The silver halide photographic emulsion used in this invention is fogged with light or a chemical fogging agent. The chemical fogging is advantageously performed according to the method described, for example, by Antoine Hautot and Henri Saubenier in Science et Industries Photographique, 28, 57–65 (1957).

The silver halide photographic emulsion used in this invention can be fogged with a reducing agent, for example, stannous chloride, thiourea dioxide, formaldehyde, hydrazine or a derivative thereof, or amine borane.

The silver halide photographic emulsion used in this invention can also be fogged with a gold compound, for example, chloroauric acid, potassium chloroaurate, or potassium aurithiosulfate.

The silver halide photographic emulsion used in this invention can be fogged also by a combination of a reducing agent and a compound of metals more electropositive than silver. Example of such metal compounds include gold compounds mentioned above, platinum compounds such as potassium chloroplatinate, and iridium compounds such as potassium hexachloroiridate.

It is also possible to fog the silver halide photographic emulsion by the combinations of the above fogging agents with a sulfur sensitizer such as sodium thiosulfate or allylthiourea or with a thiocyanate compound such as potassium thiocyanate.

The high speed direct positive silver halide photographic emulsion of this invention can be further improved in photographic speed by using the novel methine dye in combination with a known organic desensitizing dye. When the organic desensitizing dye is used in combination with those known dyes which have heretofore been proposed as a spectral sensitizer for the direct positive silver halide photographic emulsions, there occurs an amplification of the discoloration (color stain) due to the residual dyes which remain unremoved after the development treatment, whereas there is hardly observed any amplification of the discoloration with the novel dimethine dyes of this invention. Examples of known organic desensitizing dyes used in this invention include Pinacryptol Yellow, Phenosafranine, Methylene Blue, Pinacryptol Green, 3-ethyl-5-m-nitrobenzylidenerhodanine, and 3,3'-diethyl-6,6'-dinitrothiacarbocyanine iodide.

As examples of protective colloids used in this invention, mention may be made of natural colloids such as gelatin, albumin, agar, gum arabic, and alginic acid and water-soluble synthetic resins such as polyvinyl alcohol, polyvinylpyrrolidone, and cellulose ethers.

The present photographic emulsion may contain various additives such as stabilizers, whiteners, UV absorbers, hardeners, surface active agents, preservatives, plasticizers, and matting agents.

As examples of supporting materials used in the present invention, there may be mentioned films of resins such as polyethylene terephthalate and cellulose acetate; synthetic paper sheets, water-proof paper sheets, and plastics-paper laminates. If necessary, the supports can be provided on the surface with a subbing layer in a known manner. Photosensitive materials having a coating of the present direct positive silver halide photogrphic emulsion are processed in known baths of development, fixing, and bleaching, each independently or in combinations.

The first feature of this invention is such that a high speed direct positive silver halide photographic emulsion is obtained by using as a spectral sensitizer a novel dimethine dye having an indolenine ring which bears a cyano group as substituent.

The second feature of this invention is such that a high contrast direct positive silver halide photographic emulsion is obtained by the use of a novel dimethine dye having an indolenine ring which bears a cyano group as substituent.

The third feature of this invention is such that a direct positive silver halide photographic emulsion which is free from the discoloration (color stain) caused by the residual dye after processing is obtained by the use of a novel dimethine dye having an indolenine ring which bears a cyano group as substituent.

The invention is illustrated below in detail with reference to Examples, but the invention is not limited thereto.

EXAMPLE 1

Using the method of control double run, a silver iodobromide (2 mole-% iodine content) emulsion was prepared. This emulsion was a monodispersed emulsion containing silver halide grains, cubic in crystal habit, of 0.25μ in average size, 95% by weight of which being of a size within ±30% of the average value. To the emulsion, after precipitation and washing with water, was added gelatin. The emulsion was adjusted to pH 8.0 and pAg 5.0, then admixed with 2 mg/mole Ag of potassium chloroaurate, and kept at 60° C. for 2 hours to effect fogging. After having been adjusted to pAg 8.5 and pH 5.0, the emulsion was divided into a number of portions. To respective portions of the emulsion, were added each 350 mg/mole Ag of typical dimethine dyes followed by successively 200 mg/mole Ag of Pinacryptol Yellow, a hardener, and a surface active agent. Each emulsion thus obtained was coated on a subbed polyethylene-laminated paper support at a coverage of 3.7 g/m$^2$ in terms of silver nitrate. After drying, each specimen was cut to a proper size and exposed through a wedge of 0.15 in density difference. The exposed specimen was developed in Kodak D-72 developer at 20° C. for 90 seconds, then fixed in an acid fixer bath, washed with water, and dried. The results of density measurement were as shown in Table 1. In Table 1, S is a value determined at an optical density of 0.75 and expressed in relative value, assuming the blank value to be 1.0. γ represents the inclination of the linear portion between the densities of 0.5 and 1.5 of the characteristic curve. Dmin represents the minimum density.

TABLE 1

| Specimen No. | Dye No. | Photographic characteristics of each specimen S | γ | Dmin | Spectral sensitization maximum (nm) |
|---|---|---|---|---|---|
| 1 | Blank | 1.0 | 5.0 | 0.07 | — |
| 2 | 1 | 4.3 | ≧5.0 | 0.07 | 550 |
| 3 | 2 | 6.9 | " | 0.06 | 555 |
| 4 | 3 | 10.5 | " | 0.07 | 560 |
| 5 | 4 | 7.4 | " | 0.07 | 540 |
| 6 | 5 | 4.0 | " | 0.08 | 630 |
| 7 | 6 | 5.5 | " | 0.07 | 525 |
| 8 | 7 | 6.6 | " | 0.08 | 530 |
| 9 | 8 | 8.9 | " | 0.07 | 560 |
| 10 | 9 | 9.6 | " | 0.07 | 560 |
| 11 | 10 | 11.1 | " | 0.07 | 565 |
| 12 | 11 | 8.1 | " | 0.08 | 555 |
| 13 | 12 | 11.9 | " | 0.07 | 565 |
| 14 | 13 | 9.1 | " | 0.07 | 540 |
| 15 | 14 | 4.0 | " | 0.08 | 555 |
| 16 | 15 | 5.6 | " | 0.08 | 530 |
| 17 | 16 | 6.9 | " | 0.06 | 560 |
| 18 | 17 | 11.5 | " | 0.08 | 565 |
| 19 | 18 | 9.8 | " | 0.06 | 555 |

From the results shown in Table 1, it will be understood that the direct positive silver halide emulsions of this invention have high sensitivity and high contrast, and further show good clearance. Accordingly, high-speed and high-contrast direct positive silver halide photosensitive materials are obtained by the use of dimethine dyes according to this invention. There was observed no discoloration (color stain) caused by the residual dye after development processing.

EXAMPLE 2

Using the method of control double run, a silver iodobromide (2 mole % iodine content) emulsion was prepared. The silver halide grains were allowed to grow to a size of 0.16μ, admixed with 50 mg/mole Ag of potassium hexachloroiridate, left standing at 60° C. for 20 minutes, and the double run was continued until the grains had grown to an average size of 0.25μ. This raw emulsion was a monodispersed emulsion containing silver halide grains, cubic in crystal habit, of 0.25μ in average size, 95% by weight of which being of a size within ±30% of the average size. After precipitation and washing with water, the emulsion was admixed with gelatin, and adjusted to pH 6.5 and pAg 6.2. Then, the emulsion was admixed with 0.2 mg/mole Ag of thiourea dioxide, then ripened at 60° C. for 1 hour, admixed with 2 mg/mole Ag of potassium chloroaurate, and left standing at 60° C. for 1 hour to effect fogging. After having been adjusted to pAg 8.5 and pH 5.0, the emulsion was divided into a number of portions. To each portion, was added 350 mg/mole Ag of a dimethine dye. Each portion of emulsion was then treated in the same manner as in Example 1. The results of test were as shown in Table 2.

TABLE 2

| Specimen No. | Dye No. | Photographic characteristics of each specimen S | γ | Dmin | Spectral sensitization maximum (nm) |
|---|---|---|---|---|---|
| 20 | Blank | 1.0 | 5.0 | 0.09 | — |
| 21 | 19 | 9.8 | ≧5.0 | 0.10 | 620 |
| 22 | 20 | 2.5 | " | 0.12 | 570 |
| 23 | 23 | 11.4 | " | 0.08 | 565 |
| 24 | 24 | 3.4 | " | 0.08 | 550 |
| 25 | 25 | 4.2 | " | 0.12 | 630 |
| 26 | 26 | 6.6 | " | 0.12 | 600 |

From the results shown in Table 2, it will be understood that the dimethine dyes of this invention exhibit an ability to sensitize 2- to 12-fold and impart high-contrast photograhic characteristics and low Dmin to the emulsions. Accordingly, high-speed and high-contrast direct positive silver halide photosensitive materials are obtained by the use of dimethine dyes of this invention. There was observed no discoloration (color stain) caused by the residual dye after photographic processings.

EXAMPLE 3

Specimens of photosensitive materials were prepared by using the same emulsion as described in Example 1, dimethine dyes No. 3 and No. 18 of this invention, and the following reference dyes A to G. Each unexposed specimen was developed* at 30° C. for 30 seconds, fixed** at 30° C. for 30 seconds, and washed with running water for 30 seconds to obtain a specimen for the accelerating test of color clearing (discoloration due to residual dye, that is, color stain). The differences, Δa and Δb, from the blank values were determined by means of a color difference meter (Nippon Denshoku Kogyo Co.). The results of test were shown in Table 3. a and b are color scales commonly used in the color difference measurement by means of a color difference meter. The values of +a, −a, +b and −b represent the intensities of red, green, yellow, and blue colors, respectively. The values of S were obtained in the same manner as in Example 1.

*Developer: A developer was prepared according to the formulation of Kodak D-72, except that the developing agents, that is, metol and hydroquinone were omitted in order to prevent absorption of oxidation products of developing agents as well as to remove the fogging effect of said oxidation products.

**Fixer: Prepared from Rapid Fixer of Nissan Chemical Co. according to the manufacturer's direction.

Reference dye:

A

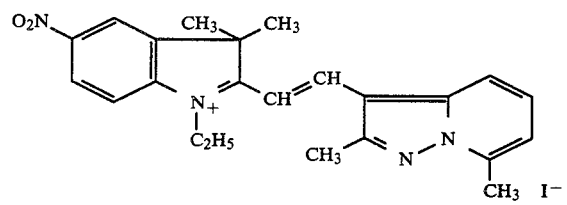

B

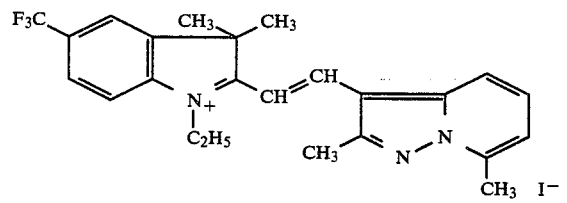

C

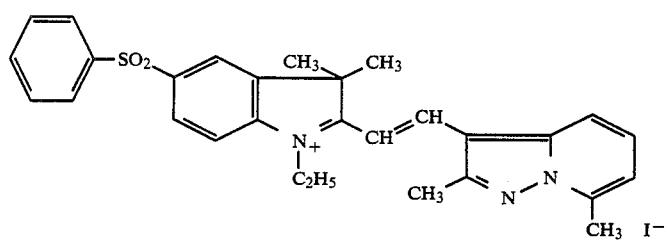

-continued

Reference dye:

D

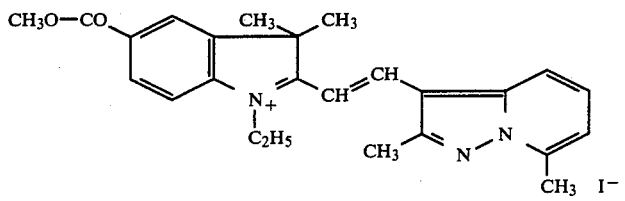

E

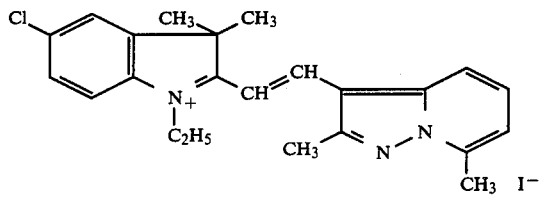

F

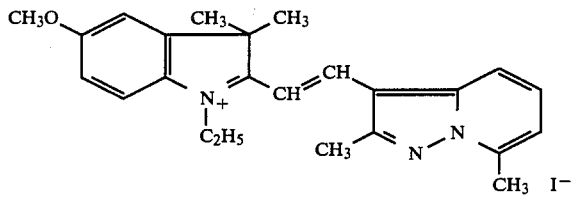

G

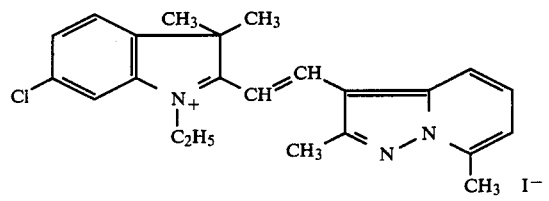

TABLE 3

| Specimen No. | Dye No. | S | Δa | Δb | Spectral sensitization maximum (nm) |
|---|---|---|---|---|---|
| 30 | Blank | 1.0 | 0.0 | 0.0 | — |
| 31 | 3 | 10.5 | +1.5 | +0.3 | 560 |
| 32 | 18 | 9.8 | +1.9 | +1.2 | 555 |
| 33 | A | 10.3 | +1.5 | +4.9 | 575 |
| 34 | B | 10.5 | +9.8 | +4.2 | 560 |
| 35 | C | 10.2 | +3.1 | +0.5 | 560 |
| 36 | D | 9.8 | +2.7 | +0.8 | 570 |
| 37 | E | 9.2 | +4.8 | +1.6 | 580 |
| 38 | F | 7.6 | +3.3 | +0.6 | 585 |
| 39 | G | 8.0 | +8.2 | +3.1 | 570 |

From the results shown in Table 3, it will be understood that the dimethine dyes of this invention exhibit high sensitivity and further give substantially no color stain caused by the residual dye after photographic processings.

What is claimed is:

1. A direct positive silver halide photographic emulsion fogged with light or chemical foggants which contains at least one dimethine spectral sensitizing dye containing a cyano-substituted indolenine ring in molecular structure and represented by the general formula:

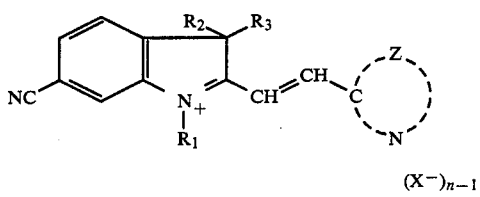

(I)

wherein $R_1$ is a group selected from a lower alkyl, a hydroxyalkyl, an acyloxyalkyl, an alkoxyalkyl, a carboxyalkyl, an alkoxycarbonylalkyl, a sulfoalkyl, an aralkyl, a sulfoaralkyl and an alkenyl, $R_2$ and $R_3$ are lower alkyl groups, Z is a group of atoms necessary to complete a nitrogen-containing 5- or 6-membered heteroring which is linked by the 1-, 3- or 4-carbon atom thereof to the dimethine chain, said nitrogen having no substituent or having a substituent selected from the group consisting of alkyl, sulfoalkyl, aryl, aralkyl and alkenyl, X is an acid anion and n is 1 or 2.

2. A direct positive silver halide emulsion according to claim 1 where Z is a group of atoms necessary to complete a pyrrole, indole, carbazole, pyrazole, pyrazolo[1,5-a]pyridine, pyrazolo[1,5-b]pyridazine, pyrazolo[1,5a]pyrazine, imidazo-[1,2-a]pyridine, 5,6-dihydropyrrolo[2,1-a]isoquinoline, indolizine, or pyrrolo[2,1-a]isoquinoline ring.

3. A method for image formation which comprises imagewise exposing the photosensitive material of claim 1 and then developing the exposed material.

4. A direct positive silver halide photographic emulsion according to claim 1 wherein amount of the dimethine dye is $1\times10^{-5}$ to $2\times10^{-2}$ mole/mole silver.

5. A direct positive silver halide photographic emulsion according to claim 1 which contains at least 80 mole% of bromide.

6. A direct positive silver halide photographic emulsion according to claim 1 wherein the dimethine dye is added in combination with a desensitizing dye.

7. A direct positive silver halide photographic emulsion according to claim 1 wherein the dimethine dye is selected from the following:

(1)

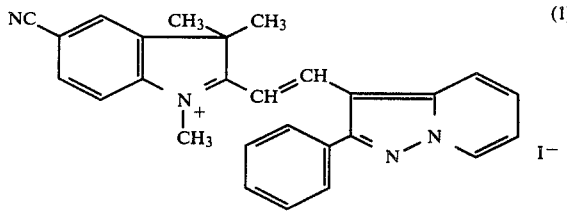

(2)

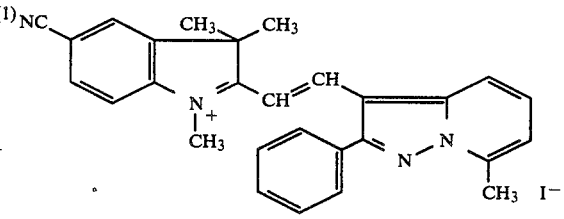

(3)

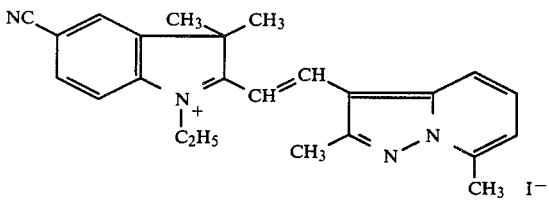

(4)

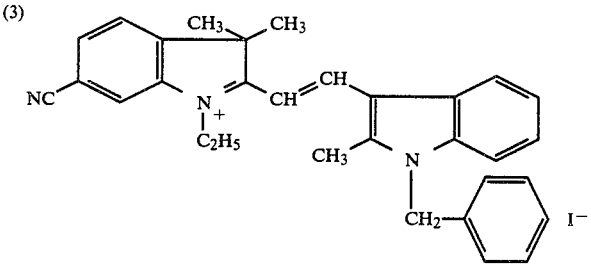

(5)

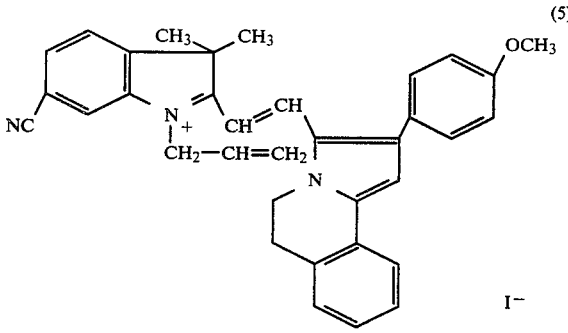

(6)

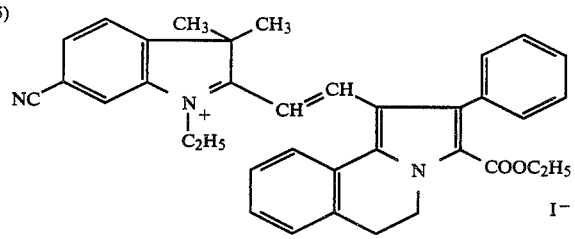

(7)

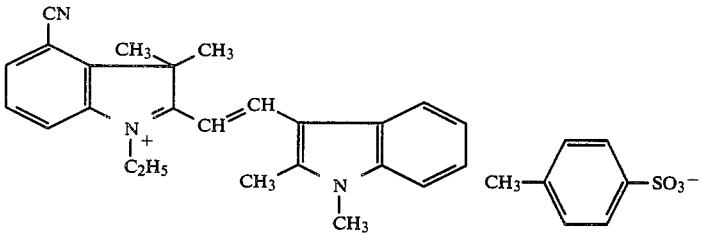

(8)

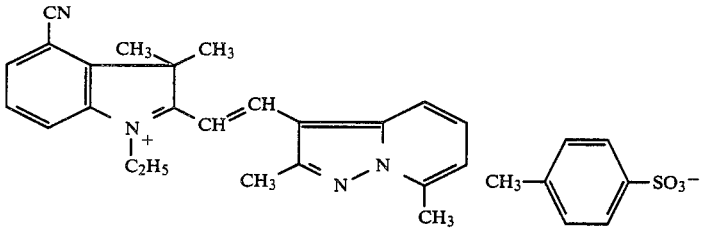

-continued
(9)
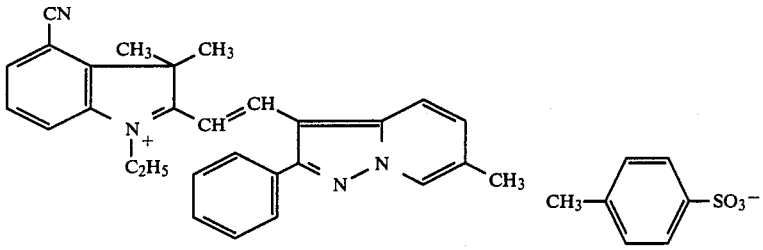
(10)
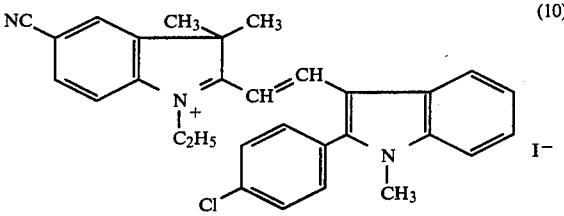
(11)
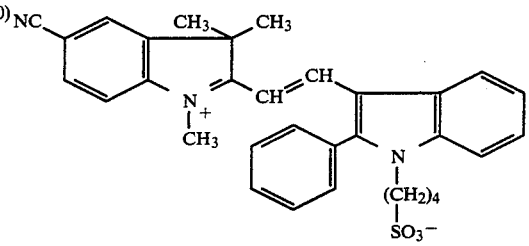
(12)
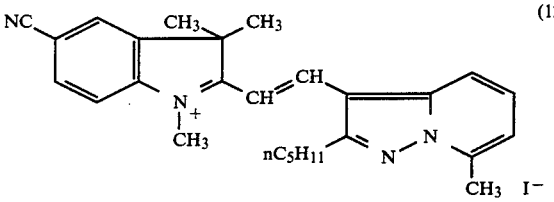
(13)
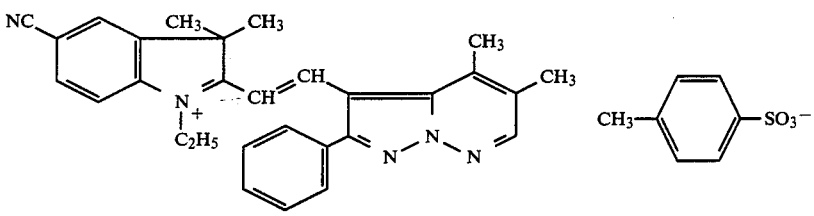
(14)
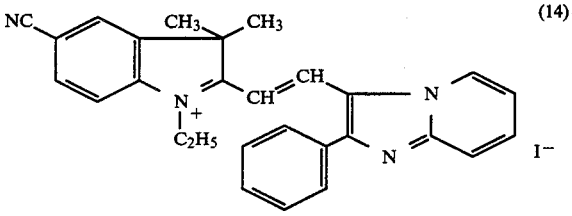
(15)
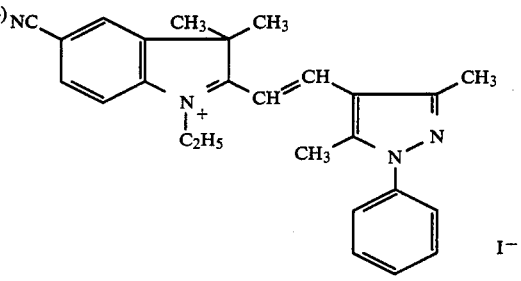
(16)
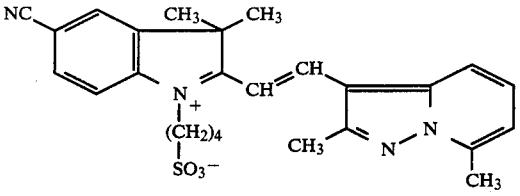
(17)
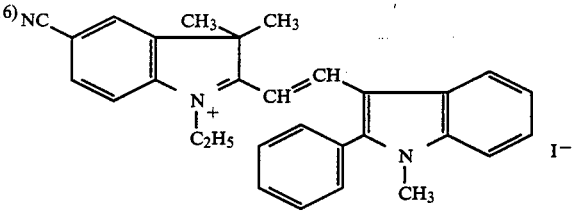
(18)
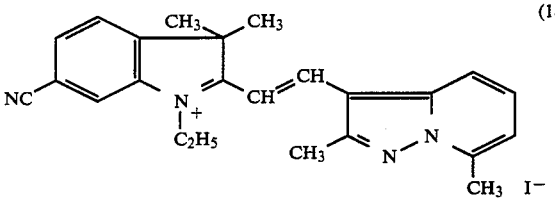

-continued
(19)
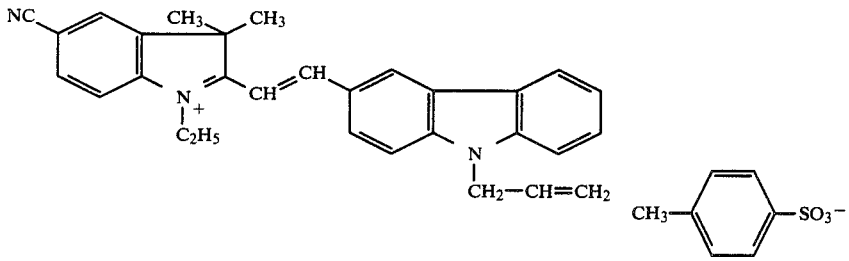
(20)
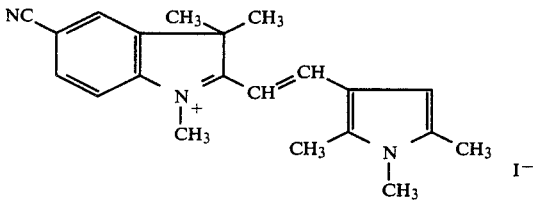
(21)
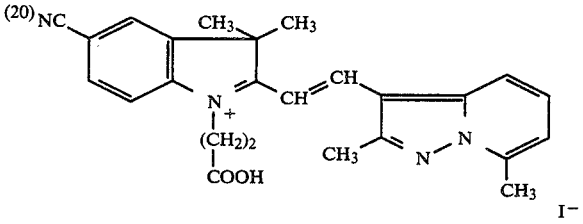
(22)
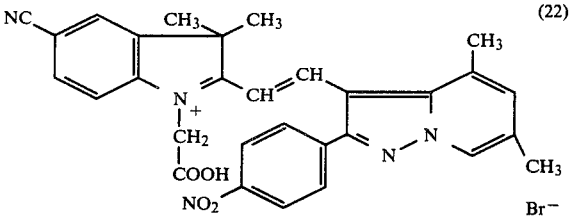
(23)
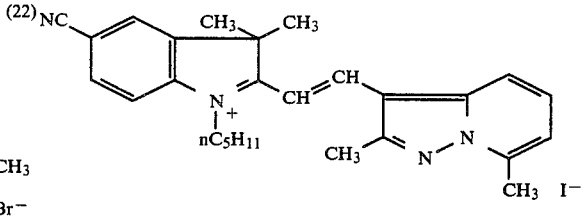
(24)
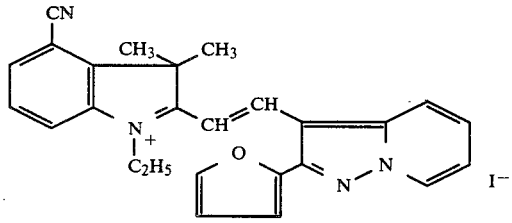
(25)
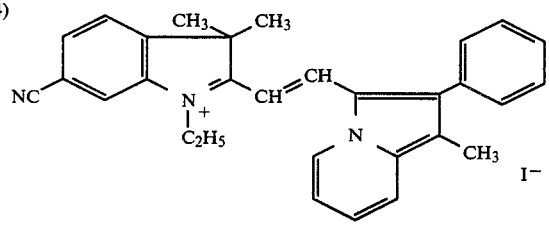
(26)
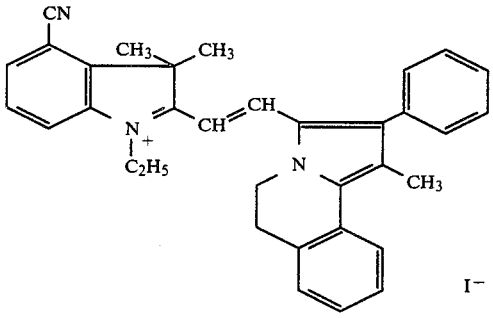
(27)
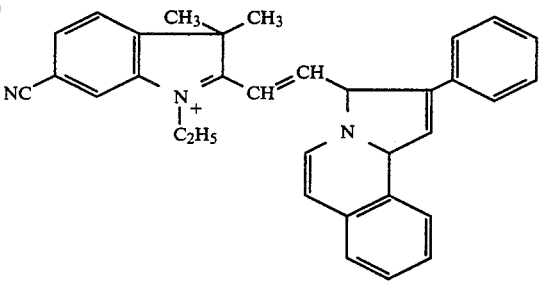
(28)
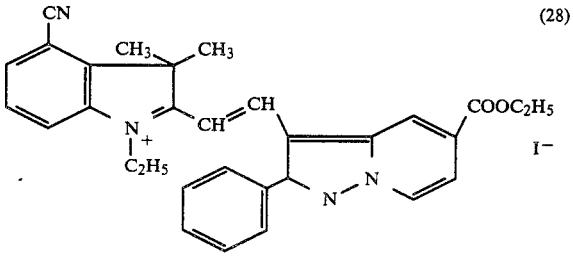
(29)
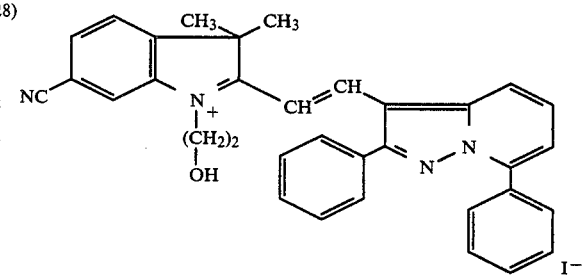
8. A photosensitive material which comprises a support and at least a silver halide emulsion layer comprising the direct positive silver halide photographic emulsion of claim 1.
* * * * *